United States Patent [19]

Moughamian

[11] Patent Number: 4,574,773

[45] Date of Patent: Mar. 11, 1986

[54] FIREPLACE HEARTH

[76] Inventor: Artine Moughamian, Saint Baudille de la Tour, FR - 38118 Hieres-sur-Amby, France

[21] Appl. No.: 638,588

[22] Filed: Aug. 7, 1984

[30] Foreign Application Priority Data

Aug. 9, 1983 [FR] France ..... 83 13239

[51] Int. Cl.[4] ..... F24B 7/00

[52] U.S. Cl. ..... 126/121; 126/126; 126/139

[58] Field of Search ..... 126/123, 121, 242, 138, 126/139; 110/173 R, 175 R, 175 A, 176, 172

[56] References Cited

U.S. PATENT DOCUMENTS

| | | | |
|---|---|---|---|
| 1,213,173 | 1/1917 | Evans | 126/138 |
| 1,727,228 | 9/1929 | Claybaugh et al. | 126/121 |
| 2,740,398 | 4/1956 | Collins | 126/242 X |
| 2,819,711 | 1/1958 | Robinson | 126/242 X |
| 4,015,579 | 4/1977 | Wirth et al. | 126/121 |
| 4,233,956 | 11/1980 | Haynes | 126/121 |
| 4,280,473 | 7/1981 | Hempel | 126/139 |

FOREIGN PATENT DOCUMENTS

| | | | |
|---|---|---|---|
| 624892 | 6/1949 | United Kingdom | 126/138 |

*Primary Examiner*—Larry Jones
*Attorney, Agent, or Firm*—Dowell & Dowell

[57] ABSTRACT

The hearth includes a hood composed on the one hand of a first screen 5*b* extending obliquely from the top of the hearth opening towards the rear and on the other hand a second screen 19 extending from the rear wall of said hearth obliquely downwardly so that its free edge 19*a* lies above the opposed edge 5*c* of the first screen 5*b*.

The opening of the hearth is closed by a guillotine-type door made by a glass panel 23 sliding in lateral slides 21, 22 invisible from the outside. The hearth further includes an intermediate chamber 10 enclosed by an outer envelop and constituting a heat exchanger.

4 Claims, 6 Drawing Figures

FIREPLACE HEARTH

The present invention relates to hearths adapted to be placed in a fireplace so as to be able to operate either as an open fire or as a closed fire, i.e. as a slow-burning stove.

The difficulty in making such hearths resides in the fact that it is necessary that the smoke be evacuated perfectly well in the two modes of combustion and more particularly during passage from one to the other.

Apart from the fact that the interior arrangement of the hearth according to the invention allows combustion of any fuel augmented by a considerable draught due to the presence of a special hood. Since the door opens by sliding it avoids the likelihood that smoke will enter the room when the door is opened, as may occur for fireplaces whose doors open "in the French style", i.e. pivoting about a vertical axis. In fact, the opening of a door "in the French style" causes a reduction in pressure inside the hearth which pulls the smoke into the room in question, whilst, with the system according to the invention comprising a sliding door, this phenomenon does not exist.

The accompanying drawing, given by way of example, will enable the invention, the characteristics that it presents and the advantages that it may procure, to be more readily understood.

Figure 1:
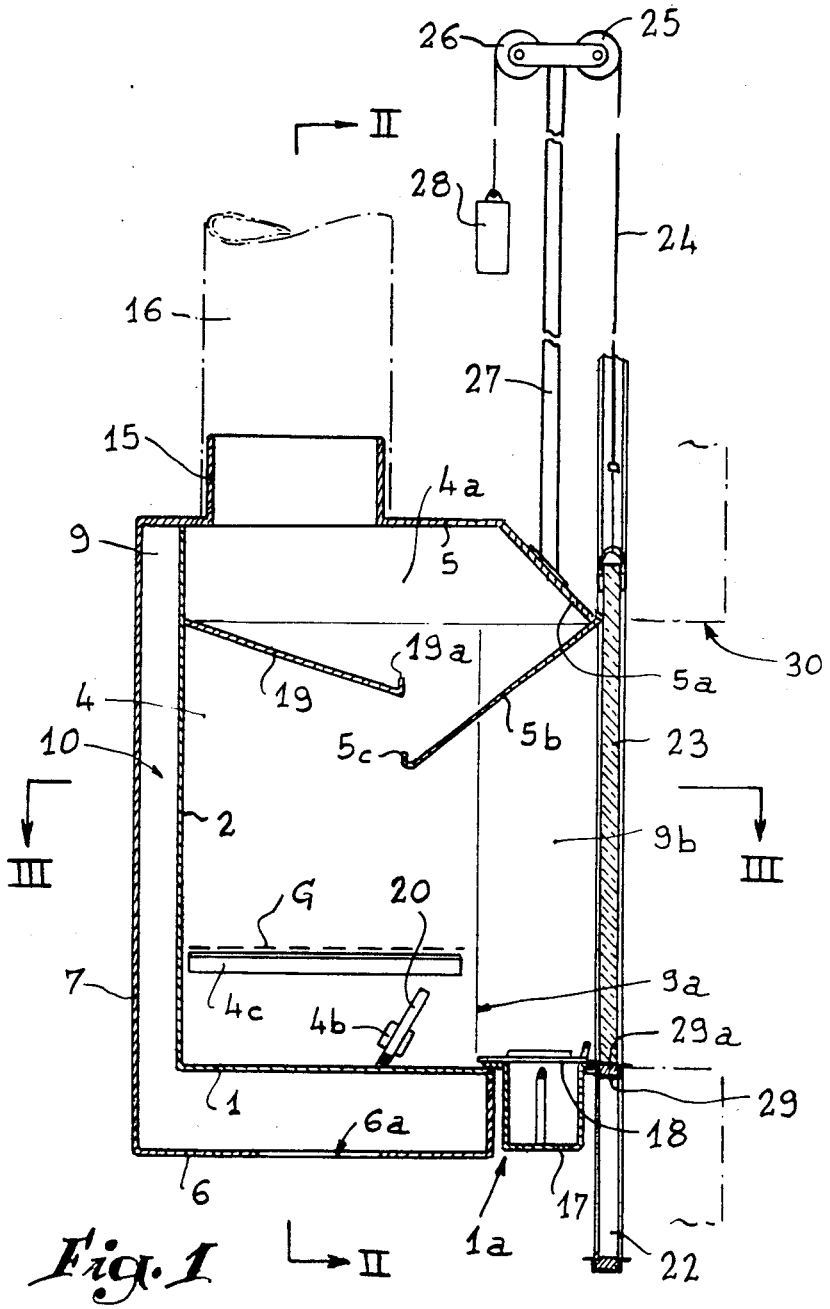
FIG. 1 is a transverse section through a hearth according to the invention.
Figure 2:
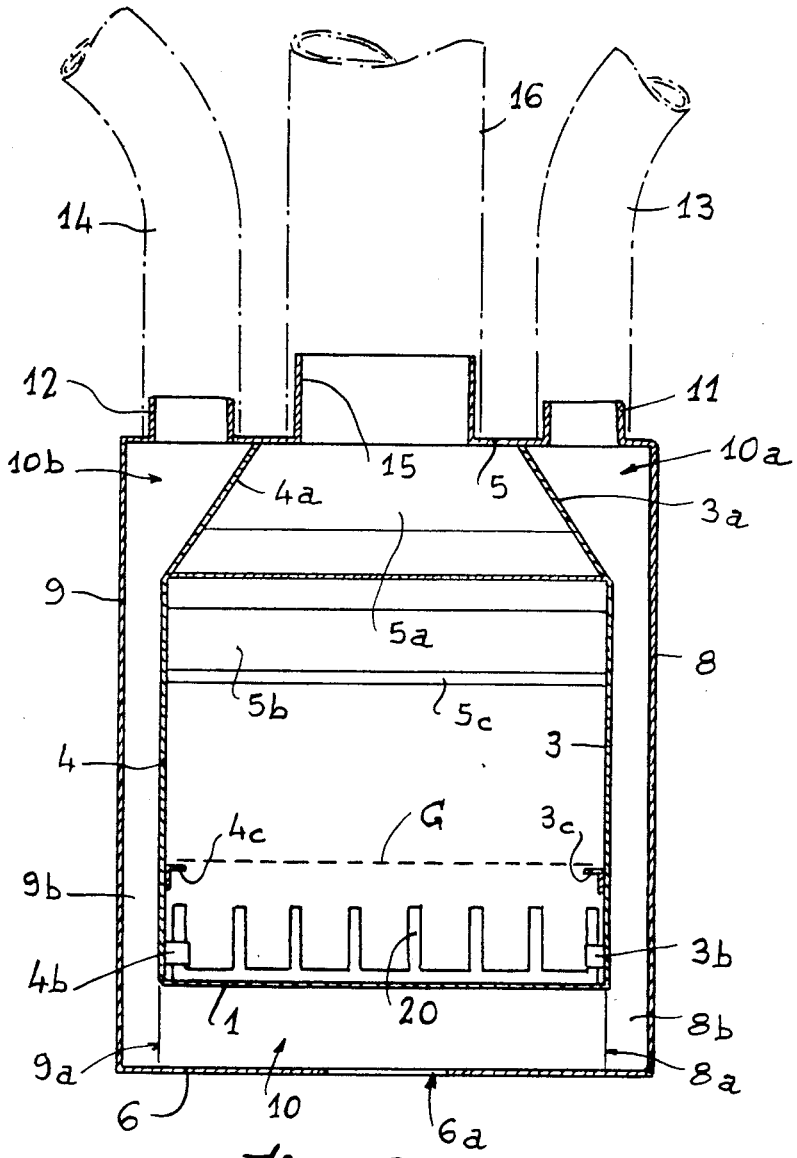
FIGS. 2 and 3 are sections thereof along II—II and III—III (FIG. 1).
Figure 4:
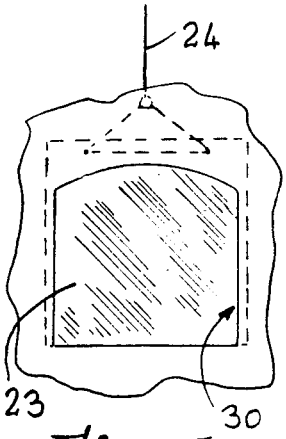
FIGS. 4 to 6 are front elevations views which illustrate the different possible positions of the sliding door of the hearth.
Figure 3:
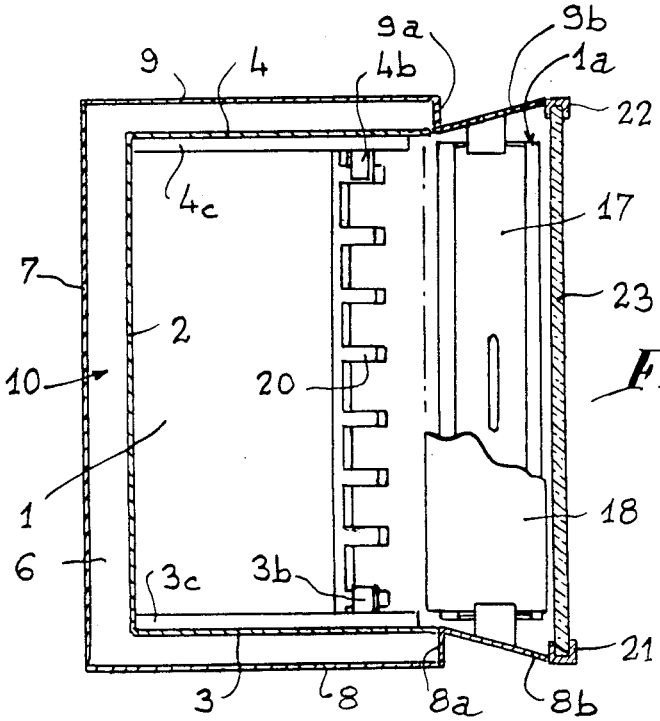

The hearth illustrated in FIGS. 1 to 3 is made in the general form of a parallelepiped with double wall, except, obviously, for the front face of the hearth which is open to allow feed thereof. The hearth proper firstly comprises a base 1 and a vertical back 2, side walls 3 and 4 being assembled on the base 1 and on the back 2. With this assembly of walls there is associated a top 5. As illustrated in FIG. 2, the upper part of the side walls 3 and 4 comprises a cant-wall 3*a*, 4*a* terminating at the top 5.

It will be noted that the assembly of faces 1, 2, 3 and 4 is placed in an enclosure taking a similar form and disposed around said assembly. Thus, beneath base 1 there is placed a panel 6 which joins by a rear partition 7 oriented vertically and by two side partitions 8 and 9. The elements 6, 7, 8 and 9 are respectively parallel to the base 1, to the back 2 and to the side walls 3 and 4 of the hearth, so as to provide an outer envelope which encloses an intermediate chamber 10. It is further observed that the top 5 of the hearth extends beyond the cant walls 3*a* and 4*a* to close the upper part of the chamber 10. In the spaces 10*a*, 10*b* in the chamber 10 between the walls 8 and 9 and the cant walls 3*a* and 4*a*, there are arranged on the top 5 annular flanges 11 and 12 adapted to be connected to flexible ducts 13, 14 adapted to conduct the hot air produced to the desired spot. The centre of the top 5 is provided with an annular connector 15 with which a smoke evacuating flue 16 is associated.

The top 5 further comprises in its front part a downwardly bent part 5*a* which is succeeded by a first downwardly oriented oblique deflection screen 5*b* terminating in a dropped stiffening edge 5*c* turned upwardly.

The panel 6 stops at a certain distance from the front edge of the base 1 which, in its part projecting beyond this panel, is provided with an elongated opening 1*a* in which is engaged an ash pan 17. Of course, there is clearance between the ash pan 17 and the edges of the opening 1*a* to allow fresh air to enter the hearth, this intake being controlled by means of a damper 18 which regulates the size of the passage of air. The panel 6 is also provided with a central opening 6*a* through which fresh air passes to enter the chamber 10 where it heats up before being evacuated through the ducts 13 and 14. The back 2 of the hearth supports a second deflection screen 19 issuing from this back and which extends obliquely downwardly, so that its free raised edge 19*a* lies above the edge 5*c* of the first screen. The assembly 5*b*–19 constitutes a hood of which the passage which extends the whole width of the hearth, is oriented vertically roughly at the centre thereof.

It will be noted that the cant walls 3*a*, 4*a* of the side walls 3 and 4 of the hearth have an origin which lies at the level of the second screen 19.

The two side walls 3 and 4 are provided on their inner faces with oblique slides 3*b*, 4*b* adapted to retain a grate 20 above which may be placed a grid G maintained by brackets 3*c*, 4*c* arranged on said walls.

It is observed in FIG. 3 that the side partitions 8 and 9 of the outer envelope comprise a double fold 8*a*–8*b*, 9*a*–9*b*. The first fold 8*a*, 9*a* being oriented perpendicularly to the side walls, whilst the other diverges outwardly. Thus the folds 8*a*, 9*a* close the intermediate chamber 10 on the front face of the hearth. It will be noted that the folds 8*b*, 9*b* are roughly coextensive with the downwardly bent part 5*a* of the top 5 (FIG. 3).

Figure 5:
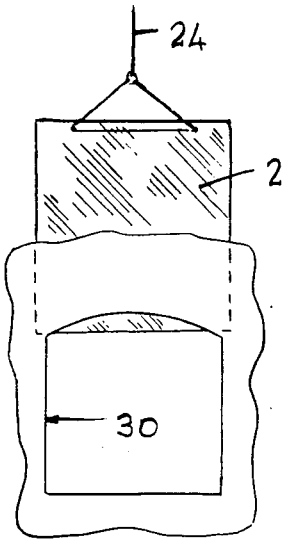
Figure 6:
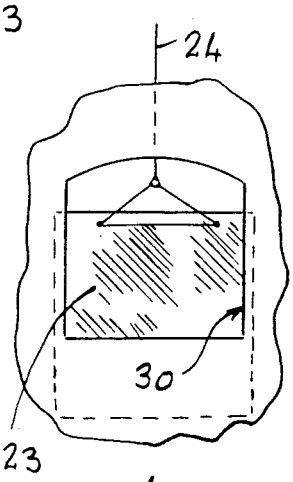

The free edges of the folds 8*b* and 9*b* join vertical slides 21, 22 which are U-shaped and in which a door made in the form of a glass panel 23 slides freely. This panel carries on its upper edge connections to a cable 24, passing over guide pulley 25, 26 mounted to rotate freely at the upper end of a vertical mast 27 whose base is fixed to the bent part 5*a* of the top 5. The cable is associated with a counterweight 28 adapted to balance the glass panel 23. It will be observed that, at the level of the base 1 of the hearth, there is placed between the slides 21, 22 a section 29 provided with an O-ring 29*a* against which the panel abuts in low position. The slides in question project extensively above and below the opening (30) of the hearth, so that, when the glass panel is raised, it disappears almost completely, as illustrated in FIG. 5, in a free space located above said opening, disengaging the latter. In addition, if it is desired to clean the inside of the glass panel 23, the section 29 is removed and then said panel is descended along the lower part of the slides 21, 22 in another empty part, so that one's hand can pass above the panel and clean its inner face, as illustrated in FIG. 6.

Finally, it will be noted that the slides 21, 22 are disposed in the outer fittings of the fireplace, with the result that they are not visible. In this way, the glass panel 23 includes no visible metal frame nor slide.

In operation, fresh air arrives through opening 6*a* in the panel to pass through the chamber 10 which constitutes a heat exchanger, so that hot air emerges at the openings of the ducts 13 and 14. If it is desired to produce open fireplace combustion, the panel 23 is raised so as to be in the position illustrated in FIG. 5. A major part of the air drawn in by the smoke evacuation flue 16 strikes against the first screen 5*b* to be deflected towards the fuel located below the grid G. The smoke produced by combustion rises vertically to strike against the second screen 19, and then it is drawn through the narrow passage located between the terminal edges of screens 5*b* and 19. The effectiveness of the hood thus constituted is such that the fuel may be of any nature, cardboard, rags, waste of all types, white wood, hard wood, live and wet wood, without any smoke escaping into the room where the fireplace is located.

In closed fireplace operation, the oxygen-carrying air arrives through the damper 18 so that the intensity of combustion may be regulated as desired by adjusting said damper. Finally, a slab of refractory brick may be placed on the brackets 3*c*, 4*c* so as to convert the hearth into a veritable oven of which the temperature is regulated by raising the glass panel 23 more or less.

It must moreover be understood that the foregoing description has been given only by way of example and that it in no way limits the domain of the invention which would not be exceeded by replacing the details of execution described by any other equivalents.

I claim:

1. An improved fireplace hearth for burning fuel on a grid and delivering smoke upwardly through a flue, the hearth having a base wall and a back wall and side walls and having a top wall which communicates with said flue, and the hearth having an open front wall and having door means selectively moveable between an open position and a closed position in which the door means closes the open front of the hearth, the improvements comprising:

(a) a first deflection screen in the hearth which extends thereacross between the side walls, the first screen being located above the grid and spaced below the top wall and extending obliquely downwardly from the open front wall and terminating at a first terminal edge located near the center of the hearth;

(b) a second deflection screen in the hearth which extends thereacross between the side walls, the second screen being located above the first screen and being spaced below the top wall and extending obliquely downwardly from the back wall and terminating at a second terminal edge located above the first terminal edge and in spaced relationship with respect thereto; and (c) the first and second screens defining an enlarged hood located above the grate and below the top wall and extending from the front to the rear wall between the side walls which hood is enclosed except for a smoke passage defined by said vertically spaced terminal edges and by the flue, the height of the hood being large as compared with the vertical spacing of said terminal edges.

2. The improved hearth as claimed in claim 1, wherein the hearth further includes a surrounding envelop having bottom and side and rear partitions, the envelop having an open front registering with said open front wall, and the partitions defining with said walls an intermediate warm air chamber coupled with warm air duct means at the top of the chamber, the side walls of the hearth being canted inwardly at their upper ends to provide space to receive warm air duct mounting flanges extending into the warm air chamber, and the bottom partition having a central opening therethrough for admitting air into the intermediate space to impinge directly against the base wall.

3. The improved hearth as claimed in claim 2, wherein the base wall and the bottom partition end short of meeting the front wall of the hearth and are joined together and leave a free space between them and the front wall, and the hearth further includes in said free space an ash pan recessed to the level of the base wall and including an air control damper.

4. The improved hearth as claimed in claim 1, wherein said base wall is elevated above ground level, and wherein said door means comprises a glass panel which is guided in vertical slides located at the front wall of the hearth, the glass panel being moveable both above and below alignment with the open front of the hearth to permit access behind the panel for cleaning it.

* * * * *